US009030691B2

(12) United States Patent
Imai

(10) Patent No.: US 9,030,691 B2
(45) Date of Patent: May 12, 2015

(54) PRINTING SYSTEM, PRINTING METHOD, AND RECORDING MEDIUM

(75) Inventor: Hitoshi Imai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 340 days.

(21) Appl. No.: 13/175,631

(22) Filed: Jul. 1, 2011

(65) Prior Publication Data

US 2012/0013946 A1 Jan. 19, 2012

(30) Foreign Application Priority Data

Jul. 15, 2010 (JP) ..... 2010-161001

(51) Int. Cl.
*G03G 15/00* (2006.01)

(52) U.S. Cl.
CPC .. *G03G 15/6576* (2013.01); *G03G 2215/00021* (2013.01); *G03G 15/5087* (2013.01)

(58) Field of Classification Search
None
See application file for complete search history.

(56) References Cited

U.S. PATENT DOCUMENTS

| | | | | |
|---|---|---|---|---|
| 6,476,923 | B1 * | 11/2002 | Cornell | 358/1.12 |
| 2006/0262337 | A1 * | 11/2006 | Kamata et al. | 358/1.13 |
| 2007/0070374 | A1 * | 3/2007 | Boyes et al. | 358/1.13 |
| 2007/0127090 | A1 * | 6/2007 | Nonaka | 358/498 |
| 2009/0286021 | A1 * | 11/2009 | Kulibert et al. | 428/32.12 |
| 2010/0265543 | A1 | 10/2010 | Imai | |

FOREIGN PATENT DOCUMENTS

| | | |
|---|---|---|
| JP | 2009-288452 | 12/2009 |

* cited by examiner

*Primary Examiner* — Ashish K Thomas
*Assistant Examiner* — Keara Harris
(74) *Attorney, Agent, or Firm* — Fitzpatrick, Cella, Harper & Scinto

(57) ABSTRACT

In tandem printing, in accordance with a printing process executed in one printing apparatus, the printing process in the other printing apparatus is automatically changed. The first printing apparatus inputs a third print job including a first print job and a second print job. An image is formed on the basis of the first print job, and on the basis of a result of the image formation, a page with a change amount in the characteristic of a recording medium after printing at a predetermined threshold value or more is detected. The second print job in which the information is changed in accordance with the change amount in the characteristic of the detected page is transmitted to the second printing apparatus.

3 Claims, 11 Drawing Sheets

FIG.6A

PRINT JOB INPUT FROM PC TO PRINTING APPARATUS A

```
JOB ATTRIBUTE DEFINITION SECTION
JOB ID = 0001
JOB TYPE = DEVICE TANDEM JOB
DEVICE TO BE PROCESSED FIRST = PRINTING APPARATUS A
DEVICE TO BE PROCESSED SECOND = PRINTING APPARATUS B
PAPER TYPE OF FIRST PAGE OF PHYSICAL PAGES: PLAIN PAPER
PAPER TYPE OF SECOND PAGE OF PHYSICAL PAGES: PLAIN PAPER

DRAWING INFORMATION DEFINITION SECTION
DRAWING ON FIRST PAGE OF LOGICAL PAGES: DRAWING OF RECTANGLE IN RED
DRAWING ON SECOND PAGE OF LOGICAL PAGES: DRAWING OF CIRCLE IN BLACK
```

FIG.6B

PRINT JOB INPUT FROM PC TO PRINTING APPARATUS B

```
JOB ATTRIBUTE DEFINITION SECTION
JOB ID = 0001
JOB TYPE = DEVICE TANDEM JOB
DEVICE TO BE PROCESSED FIRST = PRINTING APPARATUS A
DEVICE TO BE PROCESSED SECOND = PRINTING APPARATUS B
PAPER TYPE OF FIRST PAGE OF PHYSICAL PAGES: PLAIN PAPER
PAPER TYPE OF SECOND PAGE OF PHYSICAL PAGES: PLAIN PAPER

DRAWING INFORMATION DEFINITION SECTION
DRAWING ON FIRST PAGE OF LOGICAL PAGES: CLEAR DRAWING ON THE WHOLE SURFACE OF SHEET
DRAWING ON SECOND PAGE OF LOGICAL PAGES: CLEAR DRAWING ON CIRCLE
```

INFORMATION USED FOR PRINTING PROCESS DETERMINATION OF PRINTING APPARATUS B TO BE NOTIFIED FROM PRINTING APPARATUS A TO PRINTING APPARATUS B

JOB ID = 0001

INFORMATION OF FIRST PAGE pixel(100,100) - (4500,6500) = 160%
PRINTED SURFACE = DOUBLE-SIDE

INFORMATION OF SECOND PAGE pixel(1000,1000) = 100%
pixel(1001,1000) = 100%
pixel(1002,1000) = 100%
⋮
ONE-SIDE/DOUBLE-SIDE = DOUBLE SIDE

FIG.6C

PRINTING SYSTEM, PRINTING METHOD, AND RECORDING MEDIUM

BACKGROUND OF THE INVENTION

1. Field of the Invention

The present invention relates to a technology in which a print instruction is given to a printing system to which a plurality of printing apparatuses is physically connected (hereinafter this configuration will be referred to as a tandem-connected printing apparatus) and one printed matter is created for one printing medium (hereinafter this creation of the printed matter will be referred to as tandem printing).

2. Description of the Related Art

Recently, in order to give an added value to a printed matter created by combining process colors such as CMYK, a particular color expressing a color that cannot be expressed by process colors or a transparent color intended to give a glossy feeling are increasingly used. However, since these particular colors and transparent color can be handled only by a special printing apparatus in most of the cases, a value-added printing is realized by combining printing apparatuses in charge of process-color printing, particular-color printing, and transparent-color printing, respectively.

For example, process-color printing is performed by a given printing apparatus, particular-color printing is performed on the printed matter by another printing apparatus, and transparent-color printing is performed on the printed matter by still another printing apparatus. If each printing apparatus is of an electrophotographic type, in each printing process by each printing apparatus, toners are sequentially placed on the same printing medium (paper, sheet). As a result, in the second printing process (second printing apparatus) and after, a characteristic of the printing medium becomes different from that of the first printing process due to changes in weight and surface properties caused by placement of the toners. Since the characteristic of the printing medium is changed in each printing process in such tandem printing, several problems are caused.

One of the problems is a curling phenomenon. In the electrophotographic type, the curling phenomenon of the printing medium is caused in a process in which the printing apparatus fixes the toner.

The curling phenomenon means that paper on which a toner image is transferred, fixed and printed and output is curved when paper is used as the printing medium. If curling occurs, paper jamming or deterioration in a stacking capacity of a tray is caused. Thus, in order to overcome the curling in the printing apparatus, decurling process needs to be executed. However, the degree of occurrence of the curling phenomenon is changed depending on an adhesion-amount-of-toner. Therefore, depending on the adhesion-amount-of-toner in the first session of the printing process (first printing process), the curling cannot be overcome only by executing the decurling process according to the printing medium characteristic in the second session of the printing process (second printing process), which is a problem. In order to solve this problem, hitherto, a technology in which a curling correction amount by decurler in the second printing process is appropriately changed on the basis of printing medium information and the adhesion-amount-of-toner in the first printing process has been known (See Japanese Patent Laid-Open No. 2009-288452).

However, with the above prior-art technology, though the curling phenomenon caused by the tandem printing can be handled, other problems caused by the change in the characteristics of the printing medium in each printing process cannot be handled. For example, the other problems caused by the tandem printing include a problem of defective images such as defective fixation of the toner, defective surface properties and the like in the electrophotographic type. They are problems caused since appropriate printing process is not applied to the printing medium.

Also, in the prior-art technology, automatic association between a print job (and each page in a print job) and a curling correction amount corresponding to each page between respective printing apparatuses is not disclosed. Hitherto, if printed matter with the same adhesion-amount-of-toner is to be output using the same printing medium, it can be performed continuously since the same curling correction amount can be applied in the decurling process. However, in a continuous job or a continuous page output in which the printing medium or the adhesion-amount-of-toner is changed, the printing medium in the first printing process might be changed. Also, if the adhesion-amount-of-toner on the printing medium on every page is changed by the first printing process, the curling correction amount required in the second printing process is changed. Thus, in the curling correction in the second printing process, an unintended curling correction amount might be applied to an unintended page.

Therefore, there is a problem that the continuous job or continuous page output in which the type of the printing medium or the adhesion-amount-of-toner is changed needs intervention of manpower.

In the tandem-connected printing apparatus, it is intended that a plurality of apparatuses creates one printed matter in coordination without intervention of manpower, and solution of this problem is important.

SUMMARY OF THE INVENTION

An object of the present invention is to provide a printing system in which a printing process is automatically changed in other printing apparatuses in accordance with a printing process performed in one printing apparatus in the tandem-printing, a printing apparatus, a printing method, and a recording medium.

A printing system according to the present invention, in which a paper feed section of a second printing apparatus that performs printing using a second recording agent is connected to a paper discharge section of a first printing apparatus that performs printing using a first recording agent, printing process is executed in the first printing apparatus, and a sheet conveyed from the paper discharge section is fed by the paper feed section and subjected to the printing process in the second printing apparatus, wherein the first printing apparatus includes: an input unit configured to input a third print job including a first print job, which is a print job used for processing in the first printing apparatus, and a second print job, which is a print job used for processing in the second printing apparatus; an image forming unit configured to form an image using the first print job included in the third print job which is input by the input unit; a detection unit configured to detect a page on which a value indicating a characteristic in a sheet has changed by a threshold value or more by image formation and printing process using the first recording agent by the image forming unit; a first determination unit configured to determine a sheet characteristic of the page detected by the detection unit; and a first transmission unit configured to transmit the sheet characteristic determined by the first determination unit to the second printing apparatus that executes printing process of the second print job.

According to the present invention, in the tandem-printing, a printing system in which the printing process in one printing apparatuses is automatically changed in accordance with the printing process performed in the other printing apparatus, a printing apparatus, a printing method, and a recording medium can be provided.

Further features of the present invention will become apparent from the following description of exemplary embodiments (with reference to the attached drawings).

BRIEF DESCRIPTION OF THE DRAWINGS

FIGS. 6A to 6C are diagrams illustrating the print job transmitted/received between the printing apparatuses and outlines of other information in Example 2;

DESCRIPTION OF THE EMBODIMENTS

A best mode for carrying out the present invention will be described below using the attached drawings. However, constituent elements described in this embodiment are only for exemplification and not intended to limit the scope of the invention.

Figure 1:
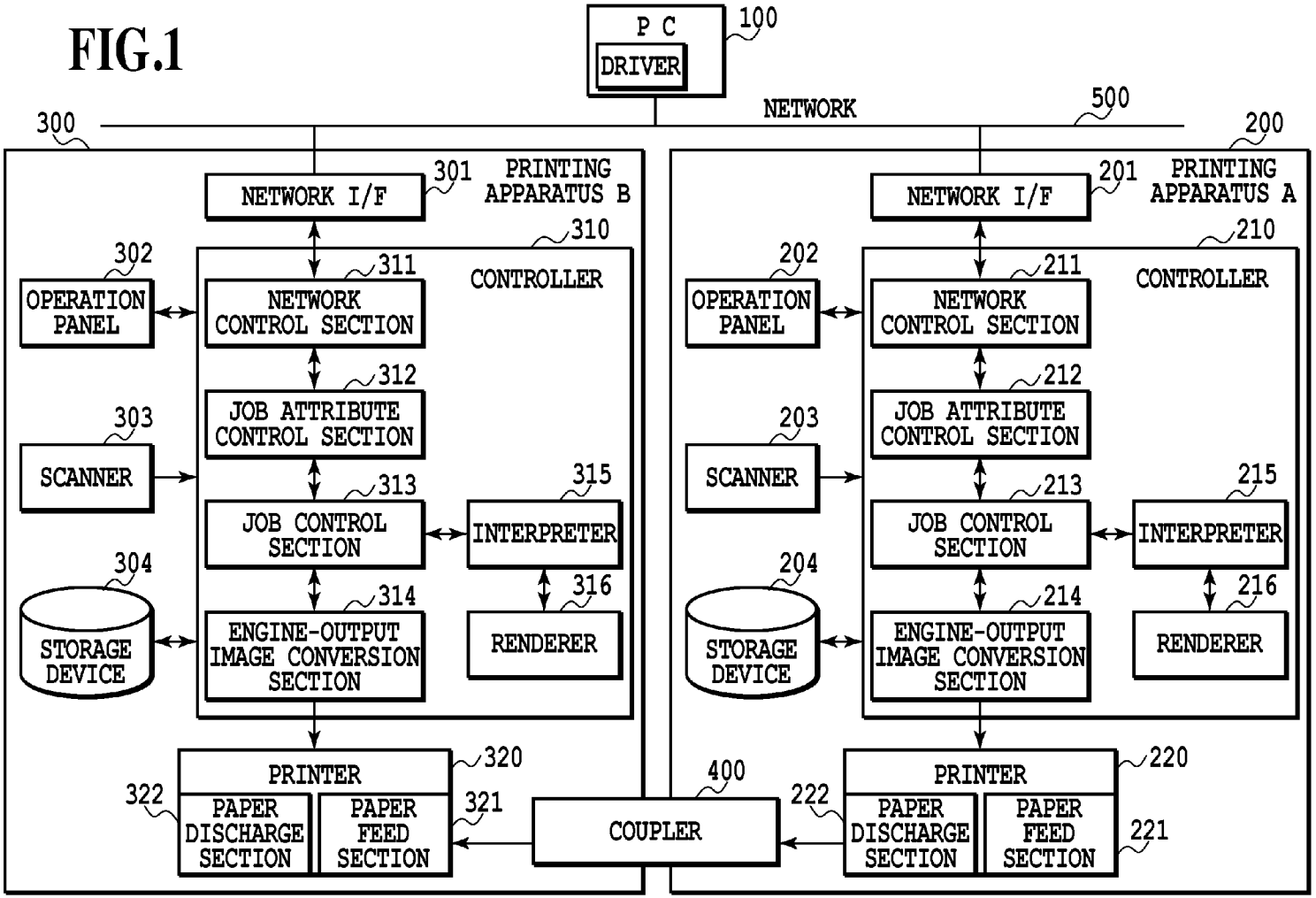
FIG. 1 is a diagram illustrating an example of a printing system provided with a printing apparatus that is tandem-connected in an embodiment.

FIG. 1 is a diagram illustrating an example of a printing system provided with a tandem-connected printing apparatus in this embodiment. As shown in FIG. 1, this printing system is provided with two units of tandem-connected printing apparatuses.

In this printing system, a PC (100) that inputs a print job such as PDL into the printing apparatus, a printing apparatus A (200), and a printing apparatus B (300) are connected by a network (500).

A paper discharge section (222) of the printing apparatus A (200) and a paper feed section (321) of the printing apparatus B (300) are physically connected by a coupler (400). As a result, a printed matter of the printing apparatus A discharged from the paper discharge section (222) of the printing apparatus A (200) can be fed by the printing apparatus B (300) from the paper feed section (321).

Also, a sheet on which printing has finished by the printing apparatus A (200) is loaded sequentially on the coupler (400) after the printing is finished. Then, the printing apparatus B (300) should take out the sheet discharged to the lowermost of the loaded sheets when feeding paper from the sheets loaded in plural on the coupler (400). In this case, there is a fear that paper feed does not go well and jamming is caused or integrity of a printing order is disturbed.

Thus, in the coupler (400), the timing of paper discharge and paper feed is controlled as follows.

A sheet of paper on which printing by the printing apparatus A (200) is finished is discharged to the paper discharge section (222) and loaded on the coupler (400) as it is.

Then, before a newly printed sheet on which printing by the printing apparatus A is finished is discharged to the coupler (400), the printing apparatus B (300) feeds the sheet placed on the coupler (400) to the paper feed section (321). As a result, the sheet is not loaded in plural on the coupler (400).

In this embodiment, the same model of the printing apparatus is used for the printing apparatus A (200) and the printing apparatus B (300). Thus, functional blocks 201 to 222 of the printing apparatus A (200) and functional blocks 301 to 322 of the printing apparatus B (300) are the same. It is needless to say that the printing apparatus A (200) and the printing apparatus B (300) may be different models, but description of such an embodiment will be omitted.

Each functional block of the printing apparatus will be described below. A network I/F (201, 301) is an interface that transmits/receives a signal to/from various information devices through the network (500). In this embodiment, the network I/F (201, 301) is used for receiving a print job from the PC (100). In addition, a controller (210, 310) is used for transmitting/receiving processing information for the printing apparatus A (200) and the printing apparatus B (300) to perform tandem-printing process. The network I/F (201, 301) is controlled by a network control section (211, 311).

An operation panel (202, 302) is provided with an operation section that receives an operation input from a user and a screen that displays information relating to the printing apparatus for a user. The operation panel (202, 302) is electrically connected to the controller (210, 310). The input from the operation panel (202, 302) is transmitted to the controller (210, 310) and displayed on the operation panel (202, 302) on the basis of a display instruction from the controller (210, 310).

A scanner (203, 303) is used when the print job is input into the printing apparatus as a paper medium and optically reads a manuscript and transmits a digitized image signal to the controller (210, 310).

A storage device (204, 304) stores a program that controls processing by the controller (210, 310) of the printing apparatus. Also, the storage device (204, 304) is used as storage unit configured to spool the print job received by the printing apparatus from the network (500) or the print job read by the scanner (203, 303) temporarily or for a long time. Moreover, the storage device (204, 304) is also used as primary storage unit of data that stores image data formed by a renderer (216, 316), which will be described later, till start of the printing process.

The controller (210, 310) is a block that controls each hardware and the interface of the printing apparatus and is executed on a CPU, not shown. The controller (210, 310) is composed by a processing block indicated by reference numerals 211 to 216 and reference numerals 311 to 316.

The network control section (211, 311) is a processing block that controls the network I/F (201, 301). The network control section (211, 311) delivers data received through the network I/F (201, 301) to a job attribute control section or transfers data received with an address from the job attribute control section to the addressed device through the network I/F (201, 301).

The job attribute control section (212, 312) determines whether data received through the network is a print job or other information. If it is a print job, the job attribute control section (212, 312) interprets the print job attribute of the print job data, transmits the contents to a job control section (213, 313), and stores the received print job data in the storage device (204, 304). If the data is other information, the job attribute control section (212, 312) does nothing with the received data but transmits the information to the job control section (213, 313). The other information includes processing information transmitted/received between controllers of the printing apparatuses when the tandem-printing process is performed by the two printing apparatuses in coordination and the like. The job attribute control section (212, 312) performs processing of rewriting the job attribute of the print job held in the storage device (204, 304), for example, in response to an instruction from the job control section (213, 313). Also, the job attribute control section (212, 312) transmits various data together with an address to the network control section (211, 311) in order to transfer the print job to the other devices.

The job control section (213, 313) receives the print job from the job attribute control section (212, 312). The job control section (213, 313) instructs image formation on the basis of drawing information stored in the storage device (204, 304) to an interpreter (215, 315) so that the print job processing is performed smoothly on the basis of the received print job. Then, the job control section instructs an engine output image conversion section (214, 314) to convert the formed image to an engine output image. The job control section (213, 313) receives the print job attribute such as printing medium information, a one-side/double-side print instruction and the like from the job attribute control section (212, 312) and receives image processing information from the interpreter (215, 315) and the engine output image conversion section (214, 314). The job control section (213, 313) determines information such as a conveying speed of a printer engine, a fixation temperature and the like on the basis of the received data and comprehensively determines the printing process. The interpreter (215, 315) reads the drawing information from the storage device (204, 304), executes interpretation process in accordance with the instruction from the job control section (213, 313) and makes the renderer (216, 316) execute rendering process so as to form image data. The formed image data is stored in memory, not shown, or in the storage device (204, 304). The engine output image conversion section (214, 314) reads the image data formed by the renderer (216, 316) from the memory, not shown, or the storage device (204, 304) in accordance with the instruction from the job control section (213, 313). The engine output image conversion section (214, 314) executes image conversion process for printing such as pseudo gradation expression process for the read-out image data. At this time, as a toner amount used in printing on each page, an adhesion-amount-of-toner in each pixel is counted. The counted adhesion-amount-of-toner information is notified to the job control section (213, 313), and the generated image for printing is converted to a video signal and transmitted to a printer (220, 320). The printer (220, 320) feeds a printing medium from the paper feed section (221, 321), executes appropriate development process on the printing medium in accordance with the received video signal and discharges the printed matter to the paper discharge section (222, 322).

A rough flow of the tandem printing in this embodiment is as follows. The printing apparatus A feeds a printing sheet as a printing medium from the paper feed section (221), executes printing process on the sheet, and discharges the printed matter to the paper discharge section (222). The coupler (400) conveys the printed matter to the paper feed section (321) of the printing apparatus B. The printing apparatus B (300) feeds the printed matter from the paper feed section (321), executes printing process thereon using a clear toner and discharges the printed matter to the paper discharge section (322). This tandem printing is realized by the controller (210) of the printing apparatus A and the controller (310) of the printing apparatus B that closely transmit/receive information of image formation process and printing process relating to the same print job via the network (500).

Example 1 and Example 2 will be described below on the basis of the above embodiment.

EXAMPLE 1

In Example 1, the PC (100) transmits one print job to the printing apparatus A (200) (first printing apparatus). The printing apparatus A (200) extracts the print job for the printing apparatus B (second printing apparatus) from the print job received from the PC (100) and transmits the print job to the printing apparatus B (300). The printing apparatus A (200) executes image formation process and printing process in accordance with the print job received from the PC (100). The printing apparatus B (300) executes the image formation process and printing process in accordance with the print job received from the printing apparatus A (200). As described above, the printing apparatus A (200) and the printing apparatus B (300) execute transmission/reception of the print job, the image formation process and printing process so as to perform the tandem printing. In the printing apparatus A (200), a color image using a CMKK toner (first color material), which is a general color toner, for example, is printed, and in the printing apparatus B (300), a clear image using a clear toner (second color material) is printed. The clear toner is a transparent recording agent having a feature of adding an image with transparency. A region printed using this clear toner is hard to be seen. Also, if the clear toner is used, a glossy feeling or luster different from printing performed by using only a colored toner can be expressed.

As a result, printing to add glossy expression by a clear image on a color image can be performed. In this example, it is assumed that each printing apparatus is set to perform one-side printing, and a printed matter on which the one-side printing is applied is output. In this example, the printing apparatus B (300) is assumed to receive only the print job from the printing apparatus A (200).

The feature of this example is that the printing apparatus B in the second stage determines a printing process to be applied to each page on the basis of printing medium (sheet) characteristic information and information indicating a target page after change notified from the printing apparatus A in the first stage. The characteristics of the sheet will be described below.

Figure 2A:
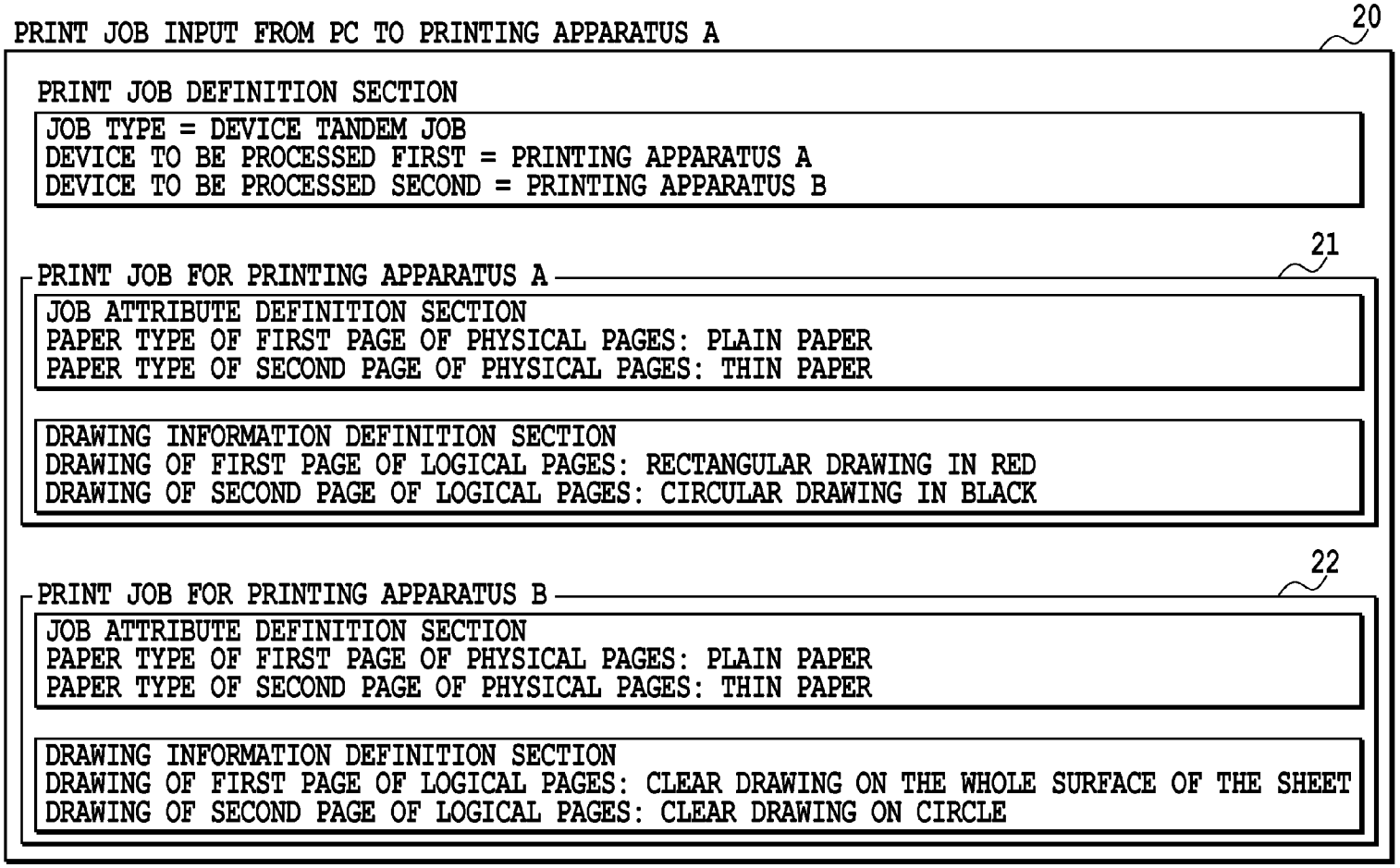
FIGS. 2A to 2D are diagrams illustrating an example of an outline of contents and a printing result of a print job in Example 1.

An outline of an example of contents of the print job and the printing result is shown in FIGS. 2A to 2D. FIG. 2A shows an example of a print job 20 (third print job) input from the PC to the printing apparatus A. In a print job definition section of this print job 20, information indicating a device tandem job (job of performing tandem printing) using two printing apparatuses, that is, a printing apparatus in the first stage as the printing apparatus A and a printing apparatus in the second stage as the printing apparatus B is stored. In this print job, a print job for the printing apparatus A and a print job for the printing apparatus B are further stored. The job for the printing apparatus A is a job used for image formation and printing process performed by the printing apparatus A. Also, the job for the printing apparatus B is a job used for the image formation and printing process performed by the printing apparatus B. In the job attribute definition section of a print job 21 for the printing apparatus A (a first print job, which is a print job for the first printing apparatus), information indicating that plain paper is used as the printing medium for the first page of physical pages and thin paper as the printing medium for the second page of the physical pages is stored. The physical pages mean pages of the printing medium which becomes a target of formation of a visible image, and one physical page is synonymous with one sheet of printing medium. Therefore, the paper type of the physical page indicates the type of the printing medium. Also, an instruction to draw a rectangle in red on the first page of logical pages and a circle in black on the second page of the logical pages is stored in a drawing information definition section. The logical pages indicate images formed on a memory space of the printing apparatus, and an image on the logical page is visualized by execution of development process using a toner on the physical pages by the printing apparatuses A and B (220, 320). The logical page can be arranged as one page on the physical page or can be arranged on plural pages by performing size-reduction layout. Also, the logical page can be arranged on the front face and the back face of the physical page, respectively. As described above, the physical page and the logical page can form a relationship not only of one to one but also one to n. In a print job 22 for the printing apparatus B, the same job attribute information as that of the printing job 21 for the printing apparatus A, that is, an instruction that the plain paper is used as the printing medium for the first page of the physical pages and thin paper as the printing medium for the second page of the physical pages is stored in the job attribute definition section. Also, an instruction that a clear image is drawn on the whole surface of the first page of the logical pages and a circular clear image with the same size as the circle to be drawn on the second page of the logical pages of the printing apparatus A is stored in the drawing information definition section.

Also, in this print job 20, as information relating to the printing medium (sheet used for printing), only paper type (plain paper or thin paper) is described but sheet size, specific paper thickness and the like may be also described.

Figure 3:
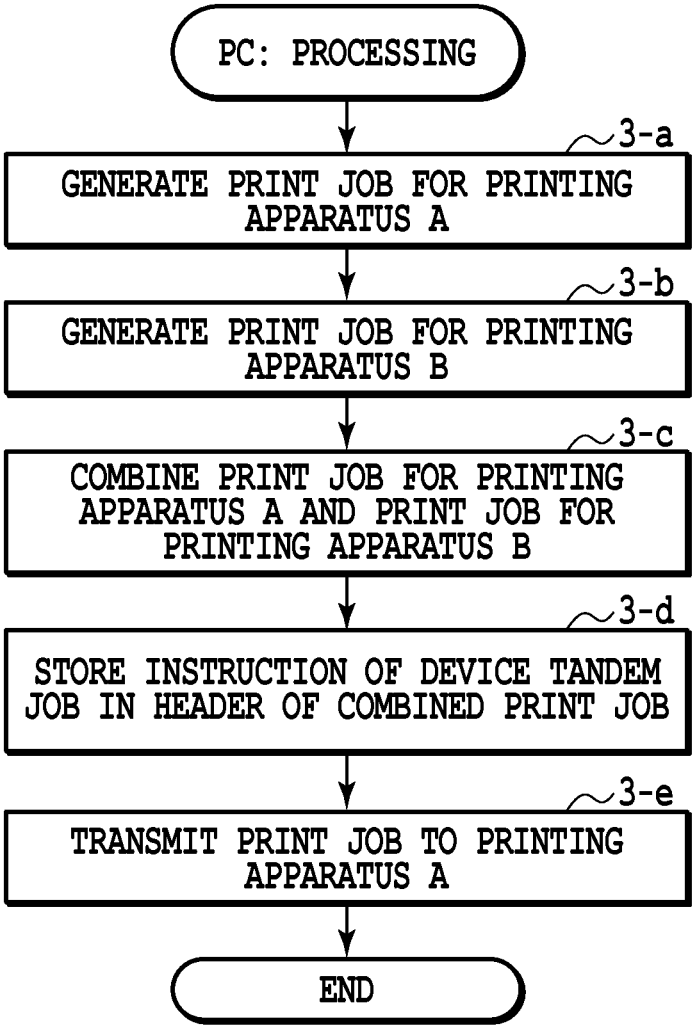
FIG. 3 is a flowchart illustrating processing in which a PC creates a print job and inputs the print job in the printing apparatus in Embodiment 1.

FIG. 3 shows a process flow in which the PC (100) generates the print job 20 and inputs the print job 20 into the printing apparatus. In the figure, 3-*a* to 3-*e* show each step of the processing. All the steps, which will be described below, are executed by an instruction of a CPU (not shown) included in the PC.

First, at Step 3-*a*, the print job 21 for the printing apparatus A is generated. At Step 3-*b*, the print job 22 for the printing apparatus B (the second print job, which is a print job for the second printing apparatus), is generated. At Step 3-*c*, the print job 21 for the printing apparatus A and the print job 22 for the printing apparatus B are combined so as to generate one print job 20. At Step 3-*d*, in the print job definition section, which is the header information of the combined print job 20, an instruction of device tandem job is stored. At Step 3-*e*, the print job 20 is transmitted to the printing apparatus A, and this processing is finished. As described above, according to the processing shown in FIG. 3, the PC (100) generates the print job 20 including the print job 21 for the printing apparatus A and the print job 22 for the printing apparatus B and transmits the print job 20 to the printing apparatus A.

Figure 4:
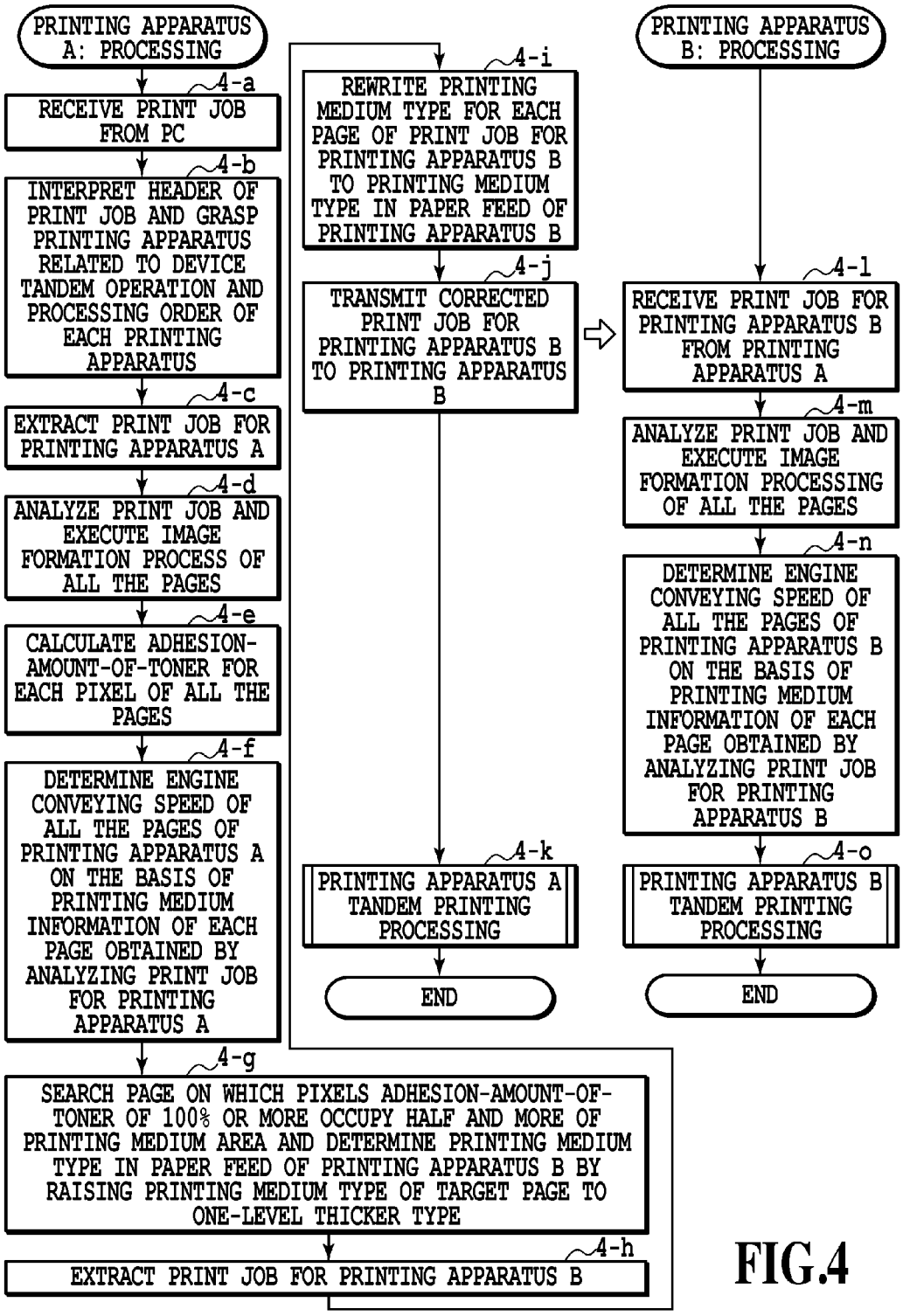
FIG. 4 is a flowchart illustrating tandem-printing process by the printing apparatus in Example 1.

FIG. 4 shows a process flow in which the printing apparatus A (200) receives the print job 20 from the PC (100), and the printing apparatus A (200) and the printing apparatus B (300) execute tandem printing process. In the figure, 4-*a* to 4-*o* show each step of the processing.

First, at Step 4-*a*, the printing apparatus A receives the print job 20 shown in FIG. 2A from the PC (100) via the network I/F (201), and the job attribute control section (212) spools the received print job data in the storage device (204). A method in which the printing apparatus A receives (inputs) the print job 20 is not limited to the above. For example, a print job held by a third printing apparatus, not shown, may be input into the printing apparatus A. Also, the print job may be downloaded from a server or other printing apparatuses through operating means such as a WEB browser installed on the printing apparatus A.

At Step 4-*b*, the job attribute control section (212) of the printing apparatus A interprets the print job definition section of the print job 20 read from the storage device (204). As a result, the printing apparatus A grasps that the tandem printing is to be performed by using the printing apparatus A as a printing apparatus in the first stage and the printing apparatus B as a printing apparatus in the second stage. The printing apparatus A may notify the printing apparatus B via the network 500 that tandem printing is to be performed from the printing apparatus A to the printing apparatus B and the printing apparatus B also may grasp that the tandem printing is to be performed at this point of time.

At Step 4-*c*, the job control section (213) extracts the print job 21 for the printing apparatus A from the print job 20.

At Step 4-*d*, the job control section (214) extracts the drawing information definition section in the print job 21 for the printing apparatus A and inputs it into the interpreter (215). The interpreter (215) interprets information of the drawing information definition section, makes the renderer (216) execute image formation process and stores a formed image of each logical page in memory, not shown. In this example, a red rectangular image is formed on the first page of the logical pages and a black circular image is formed on the second page of the logical pages.

At Step 4-*e*, the job control section (213) reads image data of each logical page formed by the renderer (216) from memory, not shown, and inputs it into the engine output image conversion section (214). The engine output image conversion section (214) converts the image data of each logical page to an engine output image so that each logical page is laid out on one side of each physical page. At that time, an adhesion-amount-of-toner of each pixel constituting each physical page is calculated, the adhesion-amount-of-toner information is associated with the engine output image data and stored in the storage device (204).

Here, in this example, the adhesion-amount-of-toner indicates a value of color expression of each pixel when an image is subjected to digital processing, and the maximum value of one process color is assumed to be 100%. For example, assuming that the color expression can be digitally expressed in CMYK value from (0, 0, 0, 0) to (255, 255, 255, 255), CMYK (255, 0, 0, 0) indicates a state in which the adhesion-amount-of-toner is 100%. CMYK (0, 0, 0, 0) indicates a state in which the adhesion-amount-of-toner is 0% and CMYK (100, 100, 100, 0) indicates a state in which the adhesion-amount-of-toner is approximately 118%.

At Step 4-*f*, first, the job attribute control section (212) interprets the job attribute definition section of the print job 21 for the printing apparatus A. On the basis of the printing medium information (sheet information) of each page obtained by the interpretation, the job control section (213) determines a printing process including the engine conveying speed of all the pages of the printing apparatus A. In this example, plain paper is designated as the printing medium of the first page and thin paper as the printing medium of the second page. Here, it is assumed that both the plain paper and thin paper can be processed at a maximum printer engine speed in the development and fixation processing, and conveying of the first page and the second page of the printing medium at the maximum speed is determined as the printing process. That is, at Step 4-*f*, the print job 21 is analyzed, and the printing process of the printing apparatus A is determined on the basis of the analysis result.

At Step 4-*g*, the job control section (213) reads the adhesion-amount-of-toner information from the storage device (204) and searches a page on which pixels with the adhesion-amount-of-toner of 100% or more occupy a half and more of the area of the printing medium. Since on such a page, much toner is placed by printing, it is determined that the characteristic of the printing medium is changed between before and after the printing. The characteristics of printing medium (sheet) include weight, surface properties and the like, but a change in the weight is used in this example for evaluation of the characteristics. For example, assume that a red rectangle printed on the first page of the physical pages has an adhesion-amount-of-toner of 160% placed on a region of 80% of the area of the printing medium and a black circle printed on the second page of the physical pages has an adhesion-amount-of-toner of 100% placed on a region of 30% of the area of the sheet. In that case, the first page of the logical pages is a target page. By setting the type of the printing medium for this page to one level thicker than the original type, the type of the printing medium in paper feed of the printing apparatus B is determined. In this example, the printing medium of the first page of the physical pages is assumed to be raised to a sheet thicker than plain paper by one level or thick paper, for example.

That is, at Step 4-*g*, first, a page with a change amount of the characteristics of the printing medium between before and after the printing at a predetermined threshold value or more (a page on which pixels with an adhesion-amount-of-toner of 100% or more occupy a half or more of the area of the printing medium) is detected. After that, the type of the printing medium close to the characteristics of the detected page is determined. In accordance with the change in the characteristics of the sheet, setting when changing the type of sheets to be used for printing is determined in advance and stored in the apparatus. For example, if the characteristics of the sheet change by the threshold value or more or if the thickness of the sheet becomes large by the adhesion-amount-of-toner during printing by the first printing apparatus, the type of the sheet is set so as to have the thickness larger by one level. The characteristics are changed such that if the type of the sheet included in the print job for the printing apparatus B is thin paper in the initial setting, the setting is changed to plain paper, if the initial setting is plain paper, the setting is changed to thick paper, or if the initial setting is thick paper, the setting is changed to emboss paper.

At Step 4-*h*, the job attribute control section (212) reads the print job 20 from the storage device (204) and extracts the print job 22 for the printing apparatus B.

Figure 2B:
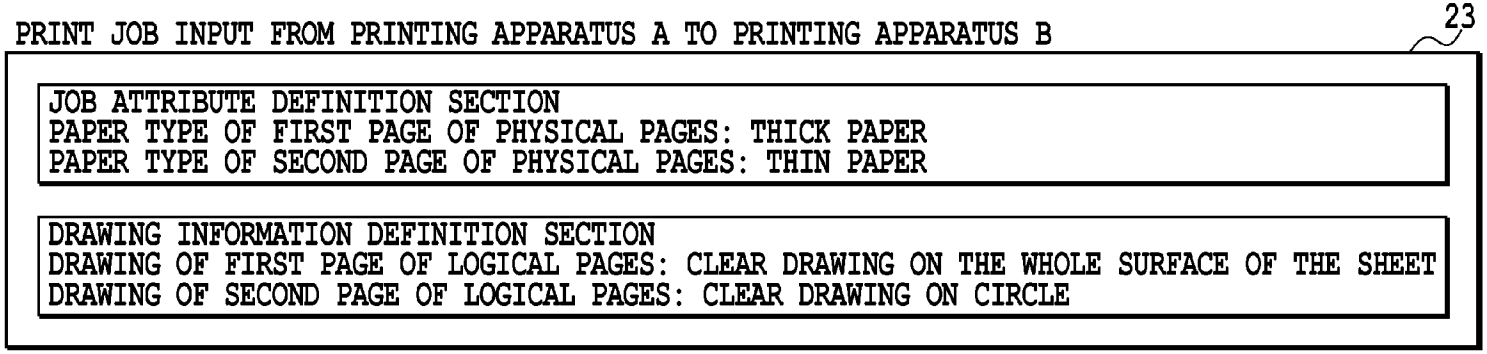

At Step 4-*i*, the job attribute control section (212) rewrites the type of the printing medium (paper type) of the first page of the physical pages stored in the job attribute definition section of the print job 22 for the printing apparatus B to the type of the printing medium in paper feed of the printing apparatus B. FIG. 2B shows an example of the print job for the printing apparatus B in which the type of the printing medium has been rewritten. In this example, the printing medium type of the first page of the physical pages has been rewritten from plain paper to thick paper.

As described above, according to the processing from Step 4-*g* to 4-*i*, in accordance with the change amount of the characteristics of the printing medium by the printing process performed in the printing apparatus A, information of the type of the printing medium in each page included in the print job for the printing apparatus B is changed. In this example, the type of the printing medium of the print job for the printing apparatus B is changed to thick paper in accordance with the adhesion-amount-of-toner, but that is not limiting. For example, if unevenness larger than a predetermined threshold value are caused in the printing medium by the printing process in the printing apparatus A, information of the type of the printing medium included in the print job for the printing apparatus B may be changed to emboss paper (sheet with unevenness). Also, if cutting is performed in finishing of the printing apparatus A and the size of the printing medium is changed (that is, a change larger than a predetermined threshold value is caused in the size of the printing medium), information of the size of the printing medium included in the print job for the printing apparatus B may be changed.

Specifically, if the characteristic of the sheet is thickness of the sheet, in the printing by the first printing apparatus, if the pixels with the adhesion-amount-of-toner larger than a threshold value occupy a half or more of the sheet area, thickness information of the sheet included in the print job for the printing apparatus B is changed to sheet thicker by one level. Also, if the characteristic of the sheet is surface properties, in the printing by the first printing apparatus, if unevenness larger than a threshold value appear on the surface of the paper, the type of paper included in the print job for the printing apparatus B is changed to emboss paper. Also, if the characteristic of the sheet is size, in the printing by the first printing apparatus, if the sheet is cut, size information of the sheet included in the print job for the printing apparatus B is changed in compliant with the cut size. These threshold values are set in advance or can be set freely by an administrator.

At Step 4-*j*, the job control section (213) transmits the print job 23 for the printing apparatus B shown in FIG. 2B modified at Step 4-*i* to the printing apparatus B (300) through network I/F (201) via the network (500) (first transmission).

At Step 4-*l*, the printing apparatus B receives the print job 23 through the network I/F (301) and the job attribute control section (312) spools the received print job data in the storage device (304). At Step 4-*m*, the interpreter (315) interprets the drawing information definition section in the print job 23 and maps the image data of the logical page formed by the renderer (316) on a physical sheet by the engine output image conversion section (314) so as to form an engine output image. In this example, a clear image is formed on the whole surface of the first page of the physical pages and a circular image to be printed using a clear toner with the same size as the circle drawn on the second page of the physical pages of the printing apparatus A is formed on the second page of the physical pages.

At Step 4-*n*, on the basis of information of the printing medium of each page obtained by the job attribute control section (312) through interpretation of the job attribute definition section in the print job 23, the job control section (313) determines a printing process of the printing apparatus B including the engine conveying speed of each page (first determination). That is, in accordance with information of the type of the printing medium of each page included in the print job 23, the printing process of each page executed by the printing apparatus B is determined.

As described above, the information of the type of the printing medium included in the print job for the printing apparatus B is changed in accordance with the characteristics of the printing medium at Step 4-*i*. Then, at Step 4-*n*, in accordance with the information of the type of the printing medium included in the print job for the printing apparatus B, the printing process of each page executed by the printing apparatus B is determined. That is, in accordance with the change in the characteristics of the printing medium caused by the printing process by the printing apparatus A, the printing process executed in the printing apparatus B is determined. As a result, in the tandem printing, the printing process in the printing apparatus B can be automatically changed in accordance with the printing process executed in the printing apparatus A.

In this example, by means of Step 4-*i* processing described above, the thick paper is designated as the printing medium of the first page and the thin paper as the printing medium of the second page. In the printing apparatus B used in this example, it is assumed that the thin paper can be processed at the maximum printer-engine speed in the development and fixation processing, but if the thick paper is processed at the maximum speed, a fixation temperature is not sufficient and defective printing is caused, and thus, setting is made such that the processing can be processed only at a half speed. As a result, conveyance of the first page of the printing medium at a half of the printer engine speed and the second page at the maximum speed is determined as the printing process.

Figure 5:
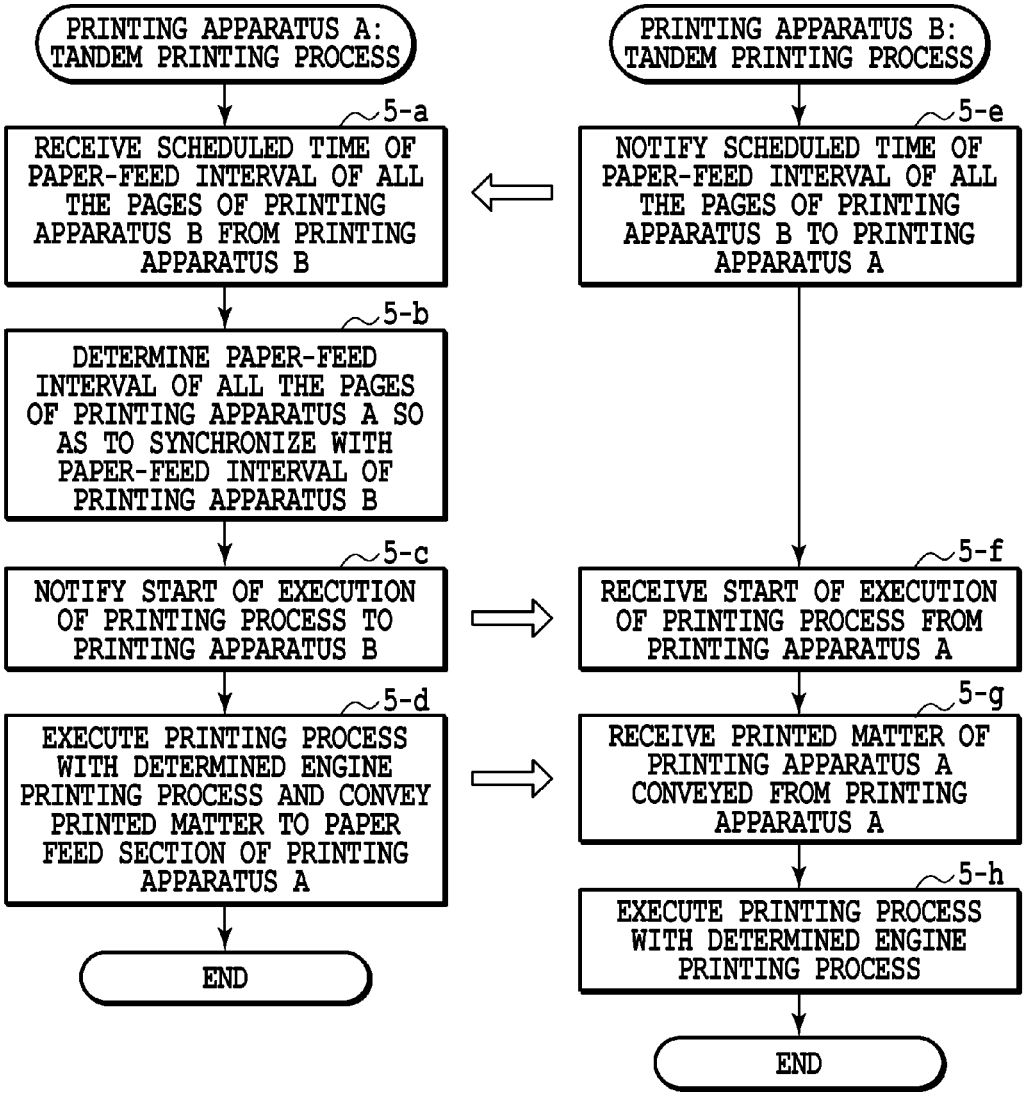
FIG. 5 is a flowchart illustrating coordination of processing performed between two units of the printing apparatuses in the tandem-printing process in Examples 1 and 2.

At Step 4-*k* and Step 4-*o*, the printing apparatus A (200) and the printing apparatus B (300) execute the tandem printing process shown in FIG. 5.

FIG. 5 is a diagram illustrating an example of a flow of the tandem printing process in which the printing apparatus A (200) and the printing apparatus B (300) execute the processing in coordination. In the figure, Steps 5-*a* to 5-*h* indicate each step.

First, at Step 5-*e*, the job control section (313) of the printing apparatus B calculates a scheduled time of an interval with which the paper feed section (321) feeds all the physical sheets in the print job on the basis of the printing process of the printing apparatus B already determined at Step 4-*n* in FIG. 4. The calculated paper-feed interval is different among pages depending on the type of the printing medium and the like. This scheduled time of paper-feed interval is notified to the printing apparatus A (200) through the network I/F (301) via the network (500) (second transmission).

At Step 5-*a*, the network I/F (201) of the printing apparatus A receives the scheduled time of paper-feed interval of all the pages of the printing apparatus B from the printing apparatus B (300). At Step 5-*b*, the job control section (213) determines the paper feed interval and/or conveying speed of all the pages of the printing apparatus A so as to synchronize with the paper-feed interval of the printing apparatus B (second determination). That is, the paper-feed interval and/or conveying speed of the printing apparatus A is not determined in accordance with the information of the paper type (type of the printing medium) included in the print job 21 for the printing apparatus A but determined in accordance with the paper-feed interval of the printing apparatus B. By determining the paper-feed interval and/or conveying speed of the printing apparatus A in accordance with the paper-feed interval of the printing apparatus B, occurrence of a problem such as paper jamming caused by a difference in the paper-feed interval between the printing apparatus A and the printing apparatus B can be prevented.

At Step 5-*c*, the job control section (213) notifies start of execution of the printing process to the printing apparatus B (300) through the network control section (211) via the network (500). At Step 5-*f*, the printing apparatus B (300) receives the start of execution of the printing process from the printing apparatus A and prepares for reception of the printed matter conveyed from the printing apparatus A (200).

At Step 5-*d*, the engine output image conversion section (214) reads the engine output image data from the storage device (204) and transfers it to the printer (220) as a video signal. The printer (220) feeds the printing medium from the paper feed section (221) in the printing process determined at Step 5-*b* on the basis of the received video signal, executes the printing process, and discharges the paper to the paper discharge section (322). At Step 5-*g*, the printing apparatus B (300) receives the printed matter of the printing apparatus A conveyed from the printing apparatus A through the coupler (400) in the paper feed section (321).

At Step 5-*h*, the engine output image conversion section (314) reads the engine output image data from the storage device (304) and transfers it to the printer (320) as a video signal. The printer (320) feeds the printing medium from the paper feed section (321) in the printing process determined on the basis of the received video signal, executes the printing process and discharges paper to the paper discharge section (322).

According to the tandem-printing process flow shown in FIG. 5, in the tandem-connected printing apparatuses the job made up by a plurality of pages, which are print targets, can be smoothly and continuously printed. In order to facilitate the description, assume that the printing apparatus A and the printing apparatus B are the same model. For example, in Example 1, the printing process is determined in accordance with the printing medium fed by the printing apparatus A at Step 4-*f*. Here, if the same printing process is applied to the printing apparatus B in accordance with its printing medium, the printer engines of the printing apparatus A and the printing apparatus B perform synchronized operations all the time, and the best performances can be realized. However, the information of the type of the printing medium included in the print job for the printing apparatus B is changed at Step 4-*i*. Thus, the printing process of the printing apparatus B determined at Step 4-*n* is different from the printing process of the printing apparatus A. If the tandem printing is performed while the printing processes are different from each other, a problem will occur as follows. Using Example 1 as an example, the printing apparatus A continuously discharges the first page and the second page of the physical pages at the maximum printer engine speed. At that time, the printing apparatus B is in the middle of conveyance of the first page of the physical pages received from the printing apparatus A at a half speed and cannot receive the second page from the printing apparatus A. Then, the printing apparatus A cannot discharge the paper and has to stop the printer engine, which causes jamming. By applying the tandem printing process flow shown in FIG. 5, the printing process of the printing apparatus A is synchronized with the printing process of the printing apparatus B, and this problem is prevented, and the tandem printing of plural pages can be executed smoothly.

In Example 1, after the processing shown in FIG. 5 is finished, the tandem printing process flow shown in FIG. 4 is finished.

Figure 2D:
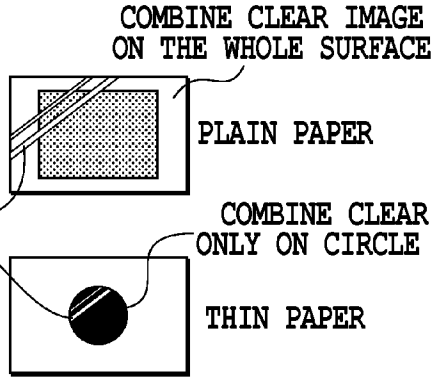
Figure 2C:
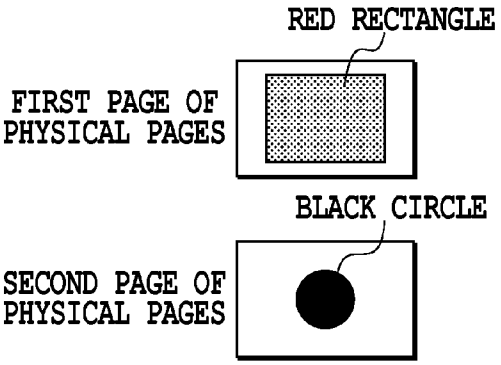

In Example 1, on the printed matter printed by the printing apparatus A (200) at Step 5-*d*, a red rectangle is printed on the first page of the physical pages as shown in FIG. 2C and a black circle is printed on the second page of the physical pages. This printed matter is fed by the printing apparatus B (300), and the printed matter printed at Step 5-*h* is created as shown in FIG. 2D. On the first page of the physical pates, a red rectangle is printed, a clear toner is applied on the whole sheet on it, a black circle is printed on the second page of the physical pages, and a clear toner is applied only on the circle section. The section on which the clear toner is applied has gloss.

As described above, by using Example 1, the printing process method can be changed dynamically by the printing apparatus in the second stage in accordance with the change in the surface state of the printing medium caused by the printing in the first stage so that the printing according to the surface state of the changed printing medium can be performed.

The color toners CMYK are used in the printing apparatus A but they are not limiting, and other color toners may be used. Similarly, the clear toner is used in the printing apparatus B but it is not limiting, and particular color toners including gold, silver and the like may be used.

According to this example, for the printing medium whose characteristics are changed by the printing in the printing apparatus A, an appropriate printing process can be applied as the printing process of the printing apparatus B. As a result, the problem of defective image caused by inappropriate printing processes can be prevented.

Also, since the appropriate printing process is automatically performed for each printing medium by the printing apparatuses in coordination, appropriate printing processes can be applied without intervention of manpower even for a continuous job in which the printing medium or the adhesion-amount-of-toner is changed or in the case of output of continuous pages.

EXAMPLE 2

In this Example 2, the PC (100) inputs the print job 21 for the printing apparatus A into the printing apparatus A (200) and inputs the print job 22 for the printing apparatus B into the printing apparatus B (300). The printing apparatus A (200) executes the image formation process and printing process in accordance with the print job 21 for the printing apparatus A. The printing apparatus B (300) executes the image formation process and printing process in accordance with the print job 22 for the printing apparatus B. As a result, tandem printing is performed. The printing apparatus A (200) prints a color image using the CMYK color toners and the printing apparatus B (300) prints a clear image using the clear toner so as to perform printing to add glossy expression by the clear image on the color image.

In this example, in order to eliminate cumbersomeness that some setting should be made both for the printing apparatus A and the printing apparatus B when the tandem printing is to be performed, by making setting related to the tandem printing only in the printing apparatus in the first stage, the setting is set so as to be also shared by the printing apparatus in the second stage. In this example, an example in which double-side printing is set for the printing apparatus A, which is s printing apparatus in the first stage, the printing apparatus A notifies the need of the double-side printing to the printing apparatus B, and a printed matter on which double-side printing is applied as the tandem printing is output will be described.

The feature of this example is as follows. That is, the printing apparatus in the second stage receives "characteristic information of the printing medium in each page before the printing apparatus in the first stage executes the printing process" and "image formation process information and printing process information affecting the characteristics of the printing medium notified by the printing apparatus in the first stage". From the received information, the printing apparatus in the second stage derives a change amount of the characteristic of the printing medium before and after the printing process in the first stage and determines the printing process to be applied to each page on the basis of the change amount.

FIGS. 6A to 6C show an example of the print job and a concept of information communicated between the printing apparatuses. FIG. 6A is an example of the print job input from the PC to the printing apparatus A. The job attribute definition section in the print job contains the following information. First, information indicating the "device tandem job using two printing apparatuses, that is, a printing apparatus in the first stage as the printing apparatus A and a printing apparatus in the second stage as the printing apparatus B". Also, information indicating "job specific ID" is stored. Moreover, information indicating that "plain paper is used both for the first page and the second page of the physical pages as the printing medium" is stored.

Also, in this print job, an instruction to draw a rectangle in red on the first page of the logical pages and to draw a circle in black on the second page of the logical pages is stored in the drawing information definition section. The job specific ID is used for identifying the same job when the tandem-connected printing apparatuses execute processing in coordination. FIG. 6B shows an example of the print job input from the PC to the printing apparatus B. In the job attribute definition section, the same contents as those of the print job input into the printing apparatus A are stored. In this print job, an instruction to draw a clear image on the whole surface of the first page of the logical pages and to draw a clear image of a circle with the same size as the circle drawn on the second page of the logical pages of the printing apparatus A on the second page of the logical pages is stored.

Figure 8:
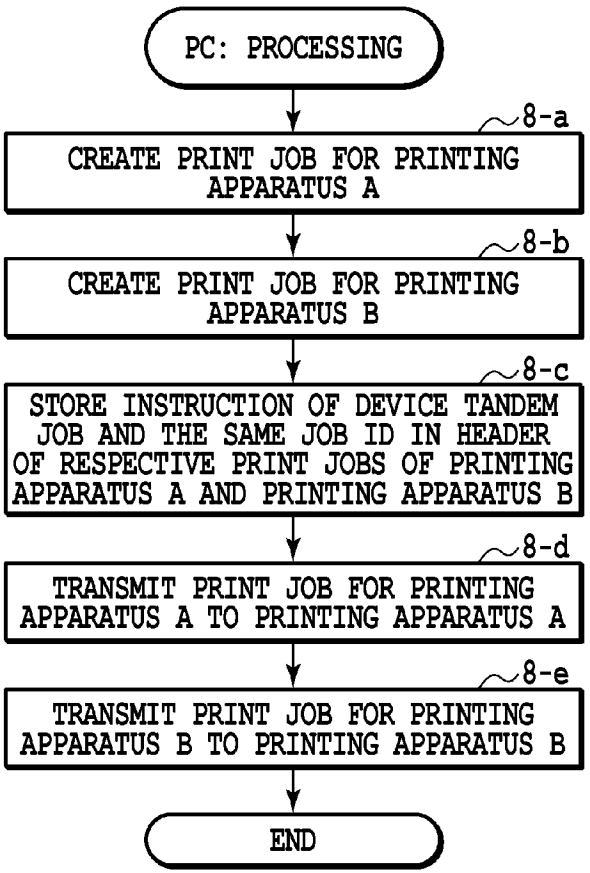
FIG. 8 is a diagram illustrating a process flow in which the PC in Embodiment 2 creates a print job and inputs the print job in the printing apparatus.

FIG. 8 is a diagram illustrating a process flow in which the PC (100) creates a print job and inputs the print job in the printing apparatus, and 8-*a* to 8-*e* in the figure indicate each step of the processing. All of the following steps are executed upon an instruction of the CPU (not shown) included in the PC.

First, at Step 8-*a*, the print job for the printing apparatus A is created. At Step 8-*b*, the print job for the printing apparatus B is created. At Step 8-*c*, in the job attribute definition sections, which are header information of the print job for the printing apparatus A and the print job for the printing apparatus B, an instruction of the device tandem job and the same job ID are stored. At Step 8-*d*, the print job for the printing apparatus A is transmitted to the printing apparatus A. At Step 8-*e*, the print job for the printing apparatus B is transmitted to the printing apparatus B, and this processing is finished.

Figure 9:
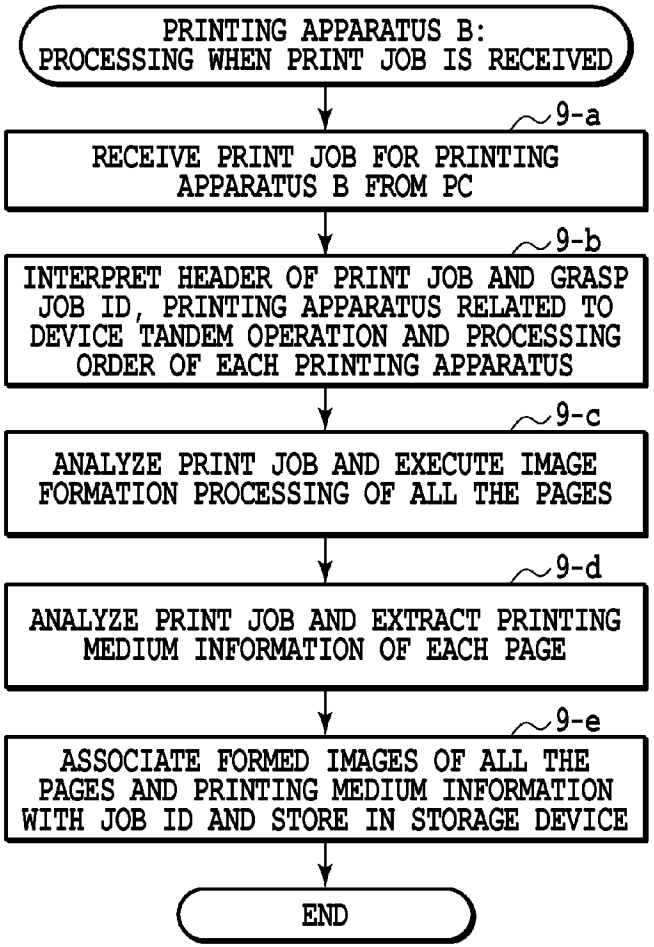
FIG. 9 is a diagram illustrating a process flow when a printing apparatus B in Example 2 receives the print job.

FIG. 9 is an example illustrating a process flow when the printing apparatus B (300) receives the print job.

At Step 9-*a*, the printing apparatus B receives the print job shown in FIG. 6B through the network I/F (301), and the job attribute control section (312) spools the received print job data in the storage device (304). At Step 9-*b*, the job attribute control section (312) interprets the job attribute definition section of the print job read from the storage device (304) and grasps the instruction of the device tandem operation using the printing apparatus A as the printing apparatus in the first stage and the printing apparatus B as the printing apparatus in the second stage and the job ID. At Step 9-*c*, the job control section (314) extracts the drawing information definition section in the print job and inputs it in the interpreter (315). The interpreter (315) interprets the information of the drawing information definition section, makes the renderer (316) execute the image formation process, and stores the formed image of each logical page in the memory, not shown. In this example, detailed description of the drawing contents will be omitted since the same contents as in Example 1 are drawn. At Step 9-*d*, on the basis of the printing medium information of each page obtained by the job attribute control section (312) through interpretation of the job attribute definition section of the print job, the job control section (313) determines the printing process or the engine conveying speed of all the pages of the printing apparatus B, here, for example. In this example, plain paper is designated as the printing medium of both the first page and the second page. At Step 9-*e*, the job control section (313) holds the image data and the printing medium information of each logical page stored in the memory, not shown, in the storage device (304) in association with the job ID, and this processing is finished.

After receiving the print job from the PC (100), the printing apparatus B (300) executes the processing shown in FIG. 9. Thus, the printing apparatus A can start the tandem printing immediately without waiting for the end of the image formation process by the printing apparatus B when starting the tandem printing.

Figure 10:
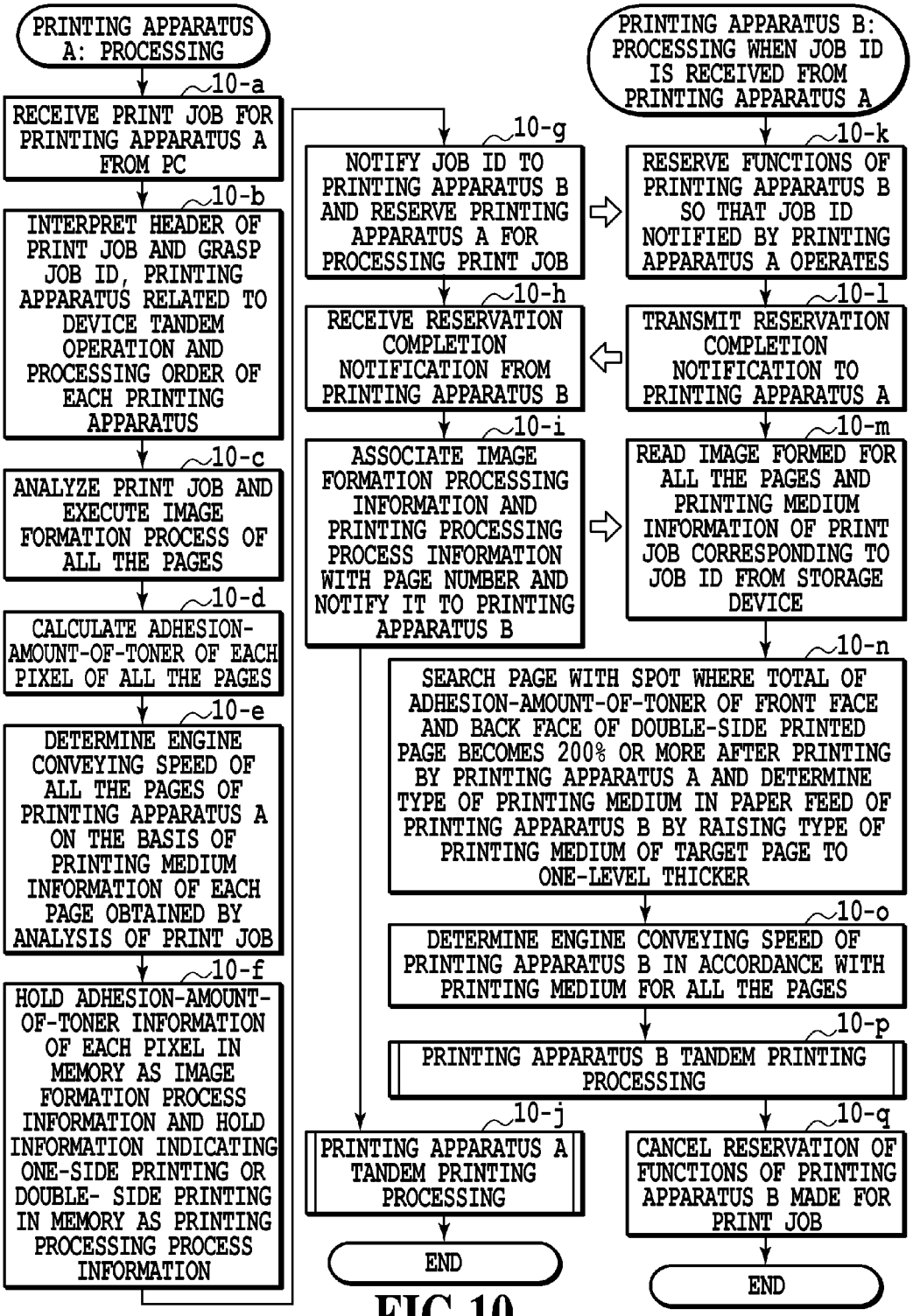
FIG. 10 is a diagram illustrating a process flow in which the printing apparatus in Example 2 performs the tandem-printing process.

FIG. 10 is a diagram illustrating a process flow in which the printing apparatus (200) receives the print job from the PC (100) and the printing apparatus A (200) and the printing apparatus B (300) execute one job using the two printing apparatuses in the printing process, and 10-*a* to 10-*q* in the figure indicate each step of the processing.

First, at Step 10-*a*, the printing apparatus A receives the print job shown in FIG. 6A through the network I/F (201) and the job attribute control section (212) spools the received print job data in the storage device (204). At Step 10-*b*, the job attribute control section (212) interprets the job attribute definition section of the print job read from the storage device (204). The job attribute control section (212) grasps the instruction of the device tandem operation using the printing apparatus A as the printing apparatus in the first stage and the printing apparatus B as the printing apparatus in the second stage and the job ID in accordance with the interpreted contents.

At Step 10-*c*, the job control section (214) extracts the drawing information definition section in the print job and inputs it into the interpreter (215). The interpreter (215) interprets information of the drawing information definition section, makes the renderer (216) execute the image formation process, and stores the formed image of each logical page in the memory, not shown. That is, at this step, in accordance with the print job received at Step 10-*a*, the image formation is executed. In this example, detailed description of the drawing contents will be omitted since the same contents as in Example 1 are drawn.

At Step 10-*d*, the job control section (213) reads the image data of each logical page formed by the renderer (216) from the memory, not shown, and inputs it into the engine output image conversion section (214). Here, as described at the beginning of this example, double-side printing setting is set for the printing apparatus A. The engine output image conversion section (214) converts the image data of each logical page to an engine output image so that each logical page is laid out on both faces of each physical page. At that time, an adhesion-amount-of-toner of each pixel constituting each physical page is calculated, and the engine output image data and the adhesion-amount-of-toner information are associated with each other and stored in the storage device (204). In this example, since two logical pages are laid out on both faces, only one physical page is output.

At Step 10-*e*, on the basis of the printing medium information of each page obtained by the job attribute control section (212) through interpretation of the job attribute definition section of the print job, the job control section (213) determines the printing process including the engine conveying speed of all the pages of the printing apparatus A. In this example, in the print job, plain paper is designated as the printing medium of the first page and the second page of the physical pages, and double-side printing is designated. Therefore, one sheet of plain paper is output as the physical page. If the double-side printing is to be performed if the printing medium designation is different between the physical first page and the second page, either one of the printing medium designations is employed, but since this operations is not related to the subject matter, the description will be omitted. Here, it is assumed that plain paper is capable of development and fixation processing at the maximum printer engine speed. Thus, conveyance of the printing medium of the first page at the maximum speed is determined as the printing process.

At Step 10-*f*, the job control section (213) holds the adhesion-amount-of-toner information for each pixel forming the image as the image formation process information and the printed face information (that is, information indicating the double-side printing in this example) as the printing process information in the memory, not shown. The image formation process information and printing process information indicate information affecting a change in the characteristics of the printing medium caused by printing. That is because the thickness or surface properties of the printing medium is changed by printing in accordance with the adhesion-amount-of-toner, which is the image formation process information, for example.

As described above, according to the processing from Step 10-*c* to 10-*f*, on the basis of the result of the determined printing process and image formation, information affecting the change in the characteristics of the printing medium by the printing in the printing apparatus A is generated and held in the memory.

At Step 10-*g*, the job control section (213) notifies the job ID to the printing apparatus B through the network I/F (201) and the network (500) as preparation for start of the tandem printing and makes reservation for the tandem printing process in the printing apparatus B. The printing apparatus B having received the notification does not accept an interrupt job other than this print job. The reason is as follows. That is, this example is different from Example 1 and is constituted so that the printing apparatus B receives the print job from a printing apparatus other than the printing apparatus A. Thus, it is necessary to prevent interruption of other print jobs in the printing apparatus B after the printing apparatus A started printing and the failure in performing the tandem printing.

At Step 10-*k*, the network I/F (301) of the printing apparatus B receives the job ID from the printing apparatus A. In order to execute job processing corresponding to the received job ID, the job attribute control section (312) makes reservation for functions of the printing apparatus B.

At Step 10-*l*, the job control section (313) notifies the fact that reservation for the functions of the printing apparatus B has been completed and clear-toner printing on the printing medium output from the printing apparatus A can be started to the printing apparatus A through the network I/F (301) and the network (500).

At Step 10-*h*, the printing apparatus A receives the notification that the reservation for the printing apparatus B has been completed and the clear-toner printing can be started from the printing apparatus B through the network I/F (201) and starts printing.

At Step 10-*i*, the job control section (213) of the printing apparatus A reads the image formation process information and printing process information generated at Step 10-*f* from the memory, not shown. The job control section (213) associates the read-out information with the page number and notifies it to the printing apparatus B through the network I/F (201) and the network (500). That is, the image formation process information and printing process information, which is information affecting the change in the characteristics of printing medium caused by the printing, is transmitted from the printing apparatus A to the printing apparatus B. As described above, by transmitting the information affecting the change in the characteristics of the printing medium caused by printing to the printing apparatus B, the printing apparatus B can expect a change amount of the characteristics of the printing medium caused by the printing in the printing apparatus A on the basis of the received information.

In this example, as the image formation process information and printing process information, specifically, the information as shown in FIG. 6C is notified by the printing apparatus A to the printing apparatus B. In this information, the ID of "0001" is included as the job ID, and thus, the printing apparatus A and the printing apparatus B can process and print one job by using the two connected printing apparatuses by processing the print job with the job ID=0001 at the same time. Also, the information of the first page stores information indicating that all the pixels present from the coordinate (100, 100) to the coordinate (4500, 6500) have the adhesion-amount-of-toner of 160% as the image formation process information. Also, as the printing process information, information indicating that the printed surface is a surface of double-side printing is stored. Moreover, the information of the second page stores information indicating that the pixel expressed by each coordinate value has a specific adhesion-amount-of-toner as the image formation process information. Also, as the printing process information, information indicating that the printed surface is a back face of the double-side printing is stored.

At Step 10-*m*, the printing apparatus B receives the notification from the printing apparatus A generated at Step 10-*i* through the network I/F (301). The job control section (313) reads an image formed for all the pages and the printing medium information corresponding to the print job corresponding to the job ID stored in the storage device (304) at Step 9-*e* from the storage device.

At Step 10-*n*, the job control section (313) searches a page having a spot where the adhesion-amount-of-toner on the front and back faces in total is 200% or more in the double-side printed pages after the printing of the printing apparatus A from the information received at Step 10-*m* (that is, the information shown in FIG. 6C). Such a page is regarded such that the surface properties of the printing medium has changed from the printing medium before the printing since a large amount of toner was placed. In this example, for example, the adhesion-amount-of-toner of a red rectangle printed on the front face of the first page of the physical pages is 160%, and the adhesion-amount-of-toner of a black circle printed on the back face of the first page of the physical pages is 100%. Thus, the total adhesion-amount-of-toner of the front and back faces of a section where the red rectangle on the front face and the black circle on the back face overlap is 260%. Then, by changing the type of the printing medium of such a page to a thicker type by one level, the type of the printing medium in paper feed of the printing apparatus B is determined. In this example, the printing medium of the first page of the physical pages is assumed to be changed to a thicker type by one level or thick paper, for example, from plain paper.

That is, at Step 10-*n*, a page with the change amount in the characteristics of the printing medium between before and after the printing is a certain threshold value or more is detected. For example, a page on which pixels with the adhesion-amount-of-toner of a predetermined ratio or more occupy a half or more of the area of the printing medium (that is, the adhesion-amount-of-toner per area of the recording medium is a predetermined amount or more) is detected. After that, the type of the printing medium close to the characteristics of the detected page is determined.

At Step 10-*o*, the job control section (313) determines the engine conveying speed of all the pages of the printing apparatus B as the printing process in accordance with the type of the printing medium determined at Step 10-*n*. In this example, the physical page is only one page and the thick paper is designated as the printing medium of the page. Here, similarly to Example 1, the thick paper can be processed only at a half speed. As a result, the fact that the first page of the printing medium is to be conveyed at a printer engine half speed is determined as the printing process.

As described above, according to the processing from Steps 10-*m* to 10-*o*, the information of the type of the printing medium of each page included in the print job for the printing apparatus B is changed in accordance with the change amount in the characteristics of the printing medium by the printing process executed in the printing apparatus A. After that, in accordance with the type of the printing medium of each page after the change, the printing process of the printing apparatus B including the paper feed speed of each page is changed. That is, on the basis of the change amount in the characteristics of the printing medium by the printing process executed in the printing apparatus A and the print job for the printing apparatus B, the printing process of the printing apparatus B including the paper feed speed is determined. Once the paper feed speed is determined, the paper-feed interval is also determined in accordance with that.

In this example, the type of the printing medium of the print job for the printing apparatus B is changed to thick paper according to the adhesion-amount-of-toner, but the change is not limiting. For example, the one described in Example 1 can be applied as a variation.

At Step 10-*j* and Step 10-*p*, the printing apparatus A (200) and the printing apparatus B (300) execute the tandem printing process shown in FIG. 5. In Example 2, after the tandem printing process flow shown in FIG. 5 is finished, at Step 10-*q*, the job control section (313) of the printing apparatus B cancels the reservation state of the functions of the printing apparatus B made at Step 10-*k* and finishes this processing.

Figure 7:
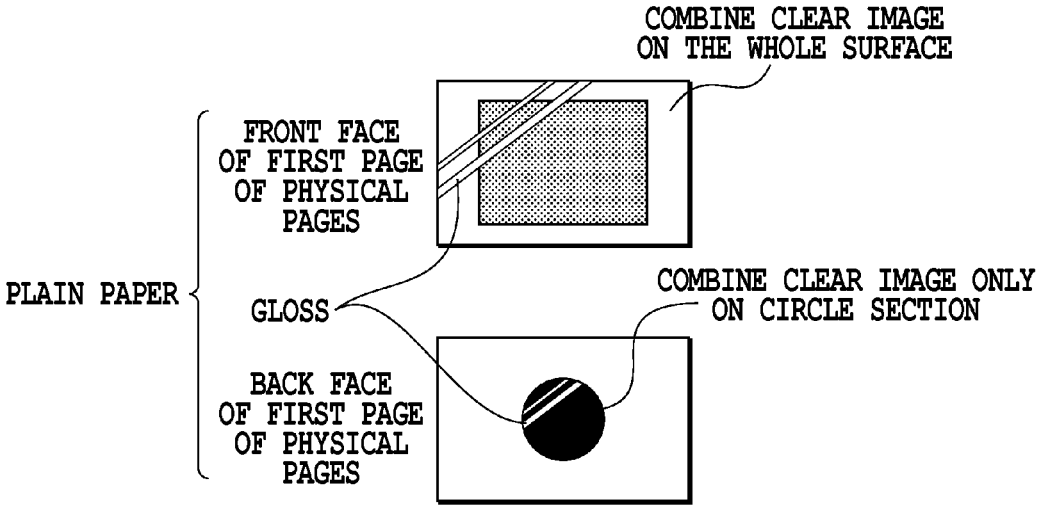
FIG. 7 is a conceptual diagram illustrating a printed matter obtained by the tandem-printing in Example 2.

As described above, in this example, the tandem-printed printed matter output by the printing apparatus B (300) at Step 5-*i* is created as shown in FIG. 7. A red rectangle is printed on the front face of the first page of the physical pages, a clear toner is applied on the whole surface on top of it, a black circle is printed on the back face of the first page of the physical pages, and a clear toner is applied only on the circle portion. The portion where the clear toner is applied has gloss.

As described above, by using Example 2, for the printing medium whose surface state is changed by the printing in the first stage, the printing apparatus in the second stage can dynamically change the printing process method in accordance with the change and can execute the printing process optimal for the changed surface state of the printing medium.

Moreover, in the case of the double-side printing on the front side, in accordance with the characteristics largely changed by the adhesion-amount-of-toner placed on the both faces of the printing medium, the printing apparatus in the second stage dynamically changes the printing process method also for the change and can execute the printing process optimal for the surface state of the printing medium after the change.

The color toners CMYK are used in the printing apparatus A but that is not limiting, and other color toners may be used. Similarly, the clear toner is used in the printing apparatus B but that it is not limiting, and particular color toners including gold, silver and the like may be used.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-161001, filed Jul. 15, 2010, which is hereby incorporated by reference herein in its entirety.

What is claimed is:

1. A printing system in which a paper feed section of a second printing apparatus that performs printing using a second recording agent is connected to a paper discharge section of a first printing apparatus that performs printing using a first recording agent, a printing process is executed in the first printing apparatus, and a sheet on which the printing process is executed by the first printing apparatus is conveyed from the paper discharge section of the first printing apparatus and fed by the paper feed section of the second printing apparatus and subjected to the printing process in the second printing apparatus, wherein the first printing apparatus comprises:

an input unit configured to input a third print job including both a first print job, which is a print job used for processing in the first printing apparatus, and a second print job, which is a print job used for processing in the second printing apparatus;

an image forming unit configured to form a logical image using the first print job included in the third print job which is input by the input unit on a sheet with its printing medium type being determined as plain paper by using the first recording agent;

a detection unit configured to detect a page in the logical image on which a value indicating a thickness of the sheet will be increased by a threshold value or more by image formation and a printing process by the image forming unit by applying the first recording agent;

a first determination unit configured to determine the thickness of the sheet of the page in the logical image detected by the detection unit and to determine a change amount in a thickness of the sheet for the page to be changed in the second print job;

a print job attribute unit configured to rewrite the second print job to change a printing medium type defined as a print job attribute included in the second print job from plain paper to thick paper based on the change amount in the thickness of the sheet determined by the first determination unit; and a first transmission unit configured to transmit the rewritten second print job to the second printing apparatus that executes printing process of the second print job, and wherein the second printing apparatus comprises:

a second determination unit configured to receive the rewritten second print job and to determine a process related to fixing conditions of the second printing apparatus using the received rewritten second print job; and a second transmission unit configured to transmit information of a paper-feed interval in the process related to fixing conditions of the second printing apparatus determined by the second determination unit to the first printing apparatus, and wherein the first printing apparatus further comprises:

a third determination unit configured to determine a paper-feed interval in the printing process of the first printing apparatus using the information of the paper-feed interval transmitted from the second printing apparatus by the second transmission unit.

2. A printing method executed in a printing system in which a paper feed section of a second printing apparatus that performs printing using a second recording agent is connected to a paper discharge section of a first printing apparatus that performs printing using a first recording agent, a printing process is executed in the first printing apparatus, and a sheet on which the printing process is executed by the first printing apparatus is conveyed from the paper discharge section of the first printing apparatus and fed by the paper feed section of the second printing apparatus and subjected to the printing process in the second printing apparatus, wherein the method executed in the first printing apparatus comprises:

an input step of inputting a third print job including both a first print job, which is a print job used for processing in the first printing apparatus, and a second print job, which is a print job used for processing in the second printing apparatus;

an image forming step of forming a logical image using the first print job included in the third print job which is input by the input step on a sheet with its printing medium type being determined as plain paper by using the first recording agent;

a detection step of detecting a page in the logical image on which a value indicating a thickness of the sheet will be increased by a threshold value or more by image formation and a printing process by applying the first recording agent;

a first determination step of determining the thickness of the sheet of the page in the logical image detected by the detection step and determining a change amount in a thickness of the sheet for the page to be changed in the second print job;

a print job attribute rewriting step of rewriting the second print job to change a printing medium type defined as a print job attribute included in the second print job from plain paper to thick paper based on the change amount in the thickness of the sheet determined by the first determination step; and a first transmission step of transmitting the rewritten second print job to the second printing apparatus that executes printing process of the second print job, wherein the method executed in the second printing apparatus comprises:

a second determination step of receiving the rewritten second print job and determining a process related to fixing conditions of the second printing apparatus using the received rewritten second print job; and a second transmission step of transmitting information of a paper-feed interval in the process related to fixing conditions of the second printing apparatus determined by the second determination step to the first printing apparatus, and wherein the method executed by the first printing apparatus further comprises:

a third determination step of determining a paper-feed interval in the printing process of the first printing apparatus using the information of the paper-feed interval transmitted from the second printing apparatus by the second transmission step.

3. A non-transitory computer-readable recording medium that stores computer-executable code of a program for causing a computer system to execute a printing method of a printing system in which a paper feed section of a second printing apparatus that performs printing using a second recording agent is connected to a paper discharge section of a first printing apparatus that performs printing using a first recording agent, a printing process is executed in the first printing apparatus, and a sheet on which the printing process is executed by the first printing apparatus is conveyed from the paper discharge section of the first printing apparatus and fed by the paper feed section of the second printing apparatus and subjected to the printing process in the second printing apparatus, the program comprising:

code for executing in the first printing apparatus:

an input step of inputting a third print job including both a first print job, which is a print job used for processing in the first printing apparatus, and a second print job, which is a print job used for processing in the second printing apparatus;

an image forming step of forming a logical image using the first print job included in the third print job which is input by the input step on a sheet with its printing medium type being determined as plain paper by using the first recording agent;

a detection step of detecting a page in the logical image on which a value indicating a thickness of the sheet will be increased by a threshold value or more by image formation and a printing process by applying the first recording agent;

a first determination step of determining the thickness of the sheet of the page in the logical image detected by the detection step and determining a change amount in a thickness of the sheet for the page to be changed in the second print job;

a print job attribute step of rewriting the second print job to change a printing medium type defined as a print job attribute included in the second print job from plain paper to thick paper based on the change amount in the thickness of the sheet determined by the first determination step; and a first transmission step of transmitting the rewritten second print job to the second printing apparatus that executes a printing process of the second print job, wherein the program further comprises code for executing in the second printing apparatus:

a second determination step of receiving the rewritten second print job and determining a process related to fixing conditions of the second printing apparatus using the received rewritten second print job; and a second transmission step of transmitting information of a paper-feed interval in the process related to fixing conditions of the second printing apparatus determined by the second determination step to the first printing apparatus, and wherein the program further comprises code for executing in the first printing apparatus further comprises:

a third determination step of determining a paper-feed interval in the printing process of the first printing apparatus using the information of the paper-feed interval transmitted from the second printing apparatus by the second transmission step.

* * * * *